US010514184B2

(12) United States Patent
Qiu et al.

(10) Patent No.: US 10,514,184 B2
(45) Date of Patent: Dec. 24, 2019

(54) IGNITION TEMPERATURE CONTROL APPARATUS OF GAS WATER HEATER

(71) Applicant: A.O.Smith(China)Water Heater Co., Ltd., Nanjing, Jiangsu Province (CN)

(72) Inventors: Bu Qiu, Nanjing (CN); Dayan Bi, Nanjing (CN); Maohu Cai, Nanjing (CN); Wei Li, Nanjing (CN)

(73) Assignee: A. O. SMITH CORPORATION, Milwaukee, WI (US)

( * ) Notice: Subject to any disclaimer, the term of this patent is extended or adjusted under 35 U.S.C. 154(b) by 63 days.

(21) Appl. No.: 15/496,941

(22) Filed: Apr. 25, 2017

(65) Prior Publication Data

US 2017/0307254 A1 Oct. 26, 2017

(30) Foreign Application Priority Data

Apr. 26, 2016 (CN) ..... 2016 1 02669368

(51) Int. Cl.
*F24H 1/00* (2006.01)
*F24H 9/20* (2006.01)
*F24H 9/18* (2006.01)

(52) U.S. Cl.
CPC ..... *F24H 9/2014* (2013.01); *F24H 1/0072* (2013.01); *F24H 9/1818* (2013.01); *F24H 9/1836* (2013.01); *F24H 9/2035* (2013.01)

(58) Field of Classification Search
CPC ..... F24H 1/00; F24H 9/1818
(Continued)

(56) References Cited

U.S. PATENT DOCUMENTS 3,908,604 A * 9/1975 Vocklinghaus ..... F23C 1/00 122/250 R
5,046,478 A * 9/1991 Clawson ..... F24H 6/00 126/101

(Continued)

FOREIGN PATENT DOCUMENTS

CN 2828663 Y 10/2006
CN 202973561 U 6/2013

(Continued)

OTHER PUBLICATIONS

Chinese Patent Office Action and Search Report for Application No. 201610266936.8 dated Mar. 23, 2018 (14 pages, English translation included).

(Continued)

*Primary Examiner* — Avinash A Savani
(74) *Attorney, Agent, or Firm* — Michael Best & Friedrich LLP

(57) ABSTRACT

The present disclosure discloses an ignition temperature control apparatus of a gas water heater, comprising: a heat exchanger made of stainless steel; a combustion device which supplies high-temperature flue gas to the heat exchanger; a water passage communicated with the heat exchanger; a first temperature detection device provided on the heat exchanger or on the water passage; a controller, wherein if a temperature detected by the first temperature detection device is lower than or equal to a first preset temperature or a rate of decline of a temperature detected by the first temperature detection device is higher than or equal to a first preset value the controller controls the combustion device to operate in such a state that a requirement for thermal bearing capacity of the heat exchanger made of stainless steel is satisfied. The heat exchanger of the ignition temperature control apparatus of the gas water heater of the present disclosure, which is made of stainless steel, has good (Continued)

thermal inertia and excellent thermal insulation properties, and thus the combustion device is started for heating when the ignition temperature control apparatus of the gas water heater is in a stop state, such that it is possible to ensure that the heat exchanger will not fail while an anti-freezing effect can be achieved.

23 Claims, 8 Drawing Sheets

(58) Field of Classification Search
USPC ..... 431/66; 126/101
See application file for complete search history.

(56) References Cited

U.S. PATENT DOCUMENTS

2005/0133021 A1* 6/2005 Kobayashi ..... F24H 8/006 126/350.1
2010/0122668 A1* 5/2010 Ando ..... F24H 1/186 122/14.3
2014/0092234 A1* 4/2014 Thomas ..... B08B 1/008 348/84
2015/0338130 A1* 11/2015 Doyama ..... F24H 9/2035 122/18.4

FOREIGN PATENT DOCUMENTS

| | | | |
|---|---|---|---|
| CN | 204100858 | U | 1/2015 |
| CN | 104990267 | A | 10/2015 |
| CN | 205619575 | U | 10/2016 |
| JP | 2013088067 | A | 5/2013 |

OTHER PUBLICATIONS

Chinese Patent Office Action for Application No. 201610266936.8 dated Apr. 23, 2019 (11 pages, English translation included).
Canadian Patent Office Action for Application No. 2,965,222 dated Jun. 4, 2018 (4 pages).
Canadian Patent Office Action for Application No. 2,965,222 dated Mar. 8, 2019 (3 pages).
Chinese Patent Office Action for Application No. 20160266936.8, dated Jan. 17, 2019, with English Translation, 11 pages.
Chinese Patent Office Action and Search Report for Applicaiton No. 201610266936.8 dated Sep. 17, 2019 (31 pages, English translation included).

* cited by examiner

IGNITION TEMPERATURE CONTROL APPARATUS OF GAS WATER HEATER

TECHNICAL FIELD

The present disclosure relates to a water heater, and in particular, to an ignition temperature control apparatus of a gas water heater.

BACKGROUND ART

Generally, an ignition temperature control apparatus of a gas water heater may comprise a heat exchanger, a combustion device, a controller, etc. The combustion device can cause a combustible gas to be combusted, and provide heat generated by the combustion to the heat exchanger, so as to change cold water into hot water.

However, if the temperature of the external environment decreases to a certain value, the ignition temperature control apparatus of the gas water heater is often damaged by frozen water in the heat exchanger or other parts.

In order to solve the technical problem, the prior art mainly takes following measures:

anti-freezing by emptying: a water drainage pipeline is provided in the ignition temperature control apparatus of the gas water heater, wherein if the temperature decreases to a certain value, the controller controls the ignition temperature control apparatus of the gas water heater to exhaust low-temperature water in the water inlet and outlet pipes and the heat exchanger to achieve the purpose of anti-freezing; this method requires a water drainage pipeline, and the structure is complex;

anti-freezing by electrical heating: an electrically heating rod is provided on the surface of the heat exchanger and/or the water inlet and outlet pipes; if the temperature decreases to a certain value, the electrically heating element is controlled for heating; in this method, since only the electrically heating element is independently used for heating, the heating is non-uniform, the anti-freezing effect is poor, and the electric energy consumption is high.

Moreover, in the prior art, the heat exchanger in the ignition temperature control apparatus of the gas water heater is at least partially made of copper. Since copper has a poor thermal inertia, i.e., the heat exchanger made of copper has a high temperature change rate when a certain amount of heat is applied thereto within a certain period, the heat exchanger made of copper has a large temperature fluctuation when being heated under the stop state, and will easily be damaged. On the other hand, since copper has a high thermal conductivity coefficient (377W/m*K), the heat dissipation is fast when the heat exchanger stops operating, so that the heat exchanger will be cooled within a short time; thus under a low environment temperature, the heat exchanger at least partially made of copper will be easily frozen within a short period of time.

SUMMARY OF THE DISCLOSURE

In order to overcome the above defects of the prior art, the technical problem to be solved by the present disclosure is to provide an ignition temperature control apparatus of a gas water heater, which can solve at least one of the above problems.

The specific technical solution of the present disclosure is as follows:

An ignition temperature control apparatus of a gas water heater, comprising:

a heat exchanger made of stainless steel;

a combustion device which supplies high-temperature flue gas to the heat exchanger;

a water passage communicated with the heat exchanger;

a first temperature detection device provided on the heat exchanger or on the water passage; and a controller, wherein if a temperature detected by the first temperature detection device is lower than or equal to a first preset temperature or a rate of decline of a temperature detected by the first temperature detection device is higher than or equal to a first preset value, the controller controls the combustion device to operate in such a state that a requirement for thermal bearing capacity of the heat exchanger made of stainless steel is satisfied.

Preferably, the heat exchanger comprises:

an enclosure frame;

a plurality of heat exchanging pipes disposed through the enclosure frame; and a water collection box communicated with ends of the heat exchanging pipes that protrude out of the enclosure frame to connect the plurality of heat exchanging pipes into a continuous flow path; and the first temperature detection device is provided on the water collection box or on the enclosure frame adjacent to the heat exchanging pipes.

Preferably, the ignition temperature control apparatus of the gas water heater comprises an exhaust pipe that is provided downstream the heat exchanger, the exhaust pipe being provided at an exhaust passage or an exit thereof with a wind cap, and when the combustion device is in a stop state, the wind cap can cause a degree of opening of the exhaust pipe to be lower than or equal to 10%.

Preferably, when the ignition temperature control apparatus of the gas water heater is in a stop state, if the temperature detected by the first temperature detection device is lower than or equal to the first preset temperature or the rate of decline of the temperature detected by the first temperature detection device is higher than or equal to the first preset value, the controller controls the combustion device to operate in the state such that the requirement for thermal bearing capacity of the heat exchanger made of stainless steel is satisfied.

Preferably, the combustion device includes a plurality of burner rows, and if the temperature detected by the first temperature detection device is lower than or equal to the first preset temperature or the rate of decline of the temperature detected by the first temperature detection device is higher than or equal to the first preset value, the controller controls all of the burner rows to start combustion.

Preferably, an electrically heating element is provided on the water passage and/or the heat exchanger.

Preferably, if the temperature detected by the first temperature detection device is lower than or equal to the first preset temperature or the rate of decline of the temperature detected by the first temperature detection device is higher than or equal to the first preset value, the controller controls the electrically heating element and the combustion device to start at the same time;

the controller first starts the combustion device, and then controls the electrically heating element to be in an operating state; or the controller first controls the electrically heating element to be in an operating state, and then starts the combustion device.

Preferably, the heat exchanger comprises:

an enclosure frame;

a plurality of heat exchanging pipes disposed through the enclosure frame; and a water collection box communicated with ends of the heat exchanging pipes that go out of the enclosure frame to connect the plurality of heat exchanging pipes into a continuous flow path;

wherein the first temperature detection device is provided on the water collection box or on a portion of the enclosure frame that is adjacent to the heat exchanging pipes; and wherein the ignition temperature control apparatus of the gas water heater includes an electrically heating element that is provided on the water passage and/or on a portion of the heat exchanger that is adjacent to the combustion device.

Preferably, if the temperature detected by the first temperature detection device is lower than or equal to a second preset temperature or a rate of decline of the temperature detected by the first temperature detection device is higher than or equal to a second preset value, the controller controls the electrically heating element to be in an operating state, and controls the combustion device to be in a stop state;

wherein the second preset temperature is higher than or equal to the first preset temperature, and the second preset value is lower than or equal to the first preset value.

Preferably, the ignition temperature control apparatus of the gas water heater includes an electrically heating element and the first temperature detection device that are provided on the water passage.

Preferably, if the temperature detected by the first temperature detection device is lower than or equal to a third preset temperature or the rate of decline of the temperature detected by the first temperature detection device is higher than or equal to a third preset value, the controller controls the electrically heating element to be in an operating state;

wherein the third preset temperature is lower than or equal to the first preset temperature, and the third preset value is higher than the first preset value.

Preferably, the ignition temperature control apparatus of the gas water heater includes an electrically heating apparatus and a driving circuit that enables the electrically heating element to operate, the driving circuit including a temperature control part that is provided on the water passage and/or on a portion of the heat exchanger that is adjacent to the combustion device, and the temperature control part being capable of enabling the driving circuit to be switched on if a temperature at a position where the temperature control part is located is lower than or equal to a fourth preset temperature.

Preferably, the electrically heating element is provided on the water passage and/or on a portion of the heat exchanger that is adjacent to the combustion device.

Preferably, a second temperature detection device and an electrically heating element are provided on a portion of the heat exchanger that is adjacent to the combustion device and/or on the water passage.

Preferably, if a temperature detected by the second temperature detection device is lower than or equal to a fifth preset temperature or a rate of decline of a temperature detected by the second temperature detection device is higher than or equal to a fifth preset value, the controller controls the electrically heating element to be in an operating state and/or the controller controls the combustion device to operate in such a state that the requirement for thermal bearing capacity of the heat exchanger made of stainless steel is satisfied.

Preferably, if the temperature detected by the second temperature detection device is lower than or equal to the fifth preset temperature or the rate of decline of the temperature detected by the second temperature detection device is higher than or equal to the fifth preset value, the controller controls the electrically heating element and the combustion device to start at the same time;

the controller first starts the combustion device, and then controls the electrically heating element to be in an operating state; or the controller first controls the electrically heating element to be in an operating state, and then starts the combustion device.

Preferably, if the temperature detected by the second temperature detection device is lower than or equal to a sixth preset temperature or the rate of decline of the temperature detected by the second temperature detection device is higher than or equal to a sixth preset value, the controller controls the combustion device to operate in such a state that that the requirement for thermal bearing capacity of the heat exchanger made of stainless steel is satisfied, wherein the sixth preset temperature is higher than or equal to the fifth preset temperature, and the sixth preset value is smaller than the fifth preset value.

Preferably, if the temperature detected by the first temperature detection device is lower than or equal to the first preset temperature or the rate of decline of the temperature detected by the first temperature detection device is higher than or equal to the first preset value, the controller controls the combustion device to operate in such a condition that a temperature of water in the heat exchanger is lower than a seventh preset temperature.

Preferably, if the temperature detected by the first temperature detection device is lower than or equal to the first preset temperature or the rate of decline of the temperature detected by the first temperature detection device is higher than or equal to the first preset value, the controller controls combustion time of the combustion device to increase as an output load decreases.

Preferably, if the temperature detected by the first temperature detection device is lower than or equal to the first preset temperature or the rate of decline of the temperature detected by the first temperature detection device is higher than or equal to the first preset value, the controller controls operation time of the combustion device to be within 8s to 10s and controls an output load to be within 11 kw to 18 kw.

Preferably, the combustion device has an anti-freezing work mode, and if the temperature detected by the first temperature detection device is lower than or equal to the first preset temperature or the rate of decline of the temperature detected by the first temperature detection device is higher than or equal to the first preset value, the combustion device operates in the anti-freezing work mode in which an output load of the combustion device is lower than or equal to 18 kw.

Preferably, the combustion device has the anti-freezing work mode with a preset power output range, and if the temperature detected by the first temperature detection device is lower than or equal to the first preset temperature or the rate of decline of the temperature detected by the first temperature detection device is higher than or equal to the first preset value, the controller controls the combustion device to operate in the anti-freezing work mode.

Preferably, if the temperature detected by the first temperature detection device is lower than or equal to the first preset temperature or the rate of decline of the temperature detected by the first temperature detection device is higher than or equal to the first preset value, the controller controls the combustion device to operate in such a state as to satisfy the requirement that a temperature of surface of the heat exchanger made of stainless steel is lower than or equal to 300° C.

Preferably, the water passage includes a water inlet pipe and a water outlet pipe that are connected to the heat exchanger.

A gas water heater comprises the above ignition temperature control apparatus.

The present disclosure has the following remarkable beneficial effects:

1. The heat exchanger made of stainless steel has a good thermal inertia and excellent thermal insulation properties, and thus, the combustion device is started for heating when the ignition temperature control apparatus of the gas water heater is in a stop state, so as to ensure that the heat exchanger will not fail while an anti-freezing effect can be achieved.

2. The electrically heating element can heat water at its position, and produce a certain effect on water in the heat exchanging pipe through convection. Thus by using the combustion device for heating and anti-freezing in coordination with the operation of the electrically heating element, the thermal insulation time of the heat exchanger can be well prolonged, and the starting frequency of the combustion device of the ignition temperature control apparatus of the gas water heater can be decreased.

3. The combustion device cannot directly act on the water inlet pipe and the water outlet pipe, and thus the water inlet pipe and/or the water outlet pipe can be prevented from freezing when being provided with the electrically heating element. In conjunction with the combustion and heating by the combustion device, the ignition temperature control apparatus of the gas water heater can be fully protected under a low temperature environment.

4. The combustion device can operate in an anti-freezing work mode, in which not only the heat exchanger made of stainless steel will not be damaged, but also the temperature in the heat exchanging pipe can be kept above the freezing temperature to prevent the heat exchanger from being frozen.

5. The heat exchanger made of stainless steel has a longer service life than the heat exchanger made of copper.

BRIEF DESCRIPTION OF THE DRAWINGS

The accompanying drawings are described herein merely for the purpose of explanation, and not intended to limit the scope disclosed by the present disclosure in any way. In addition, the shapes and proportional dimensions of components in the accompanying drawings are only illustrative for facilitating understanding the present disclosure, rather than specifically defining the shapes and proportional dimensions of components of the present disclosure. Being taught by the present disclosure, a person skilled in the art can implement the present disclosure by selecting various possible shapes and proportional dimensions depending on the specific circumstances.

LIST OF REFERENCE NUMERALS

Figure 1:
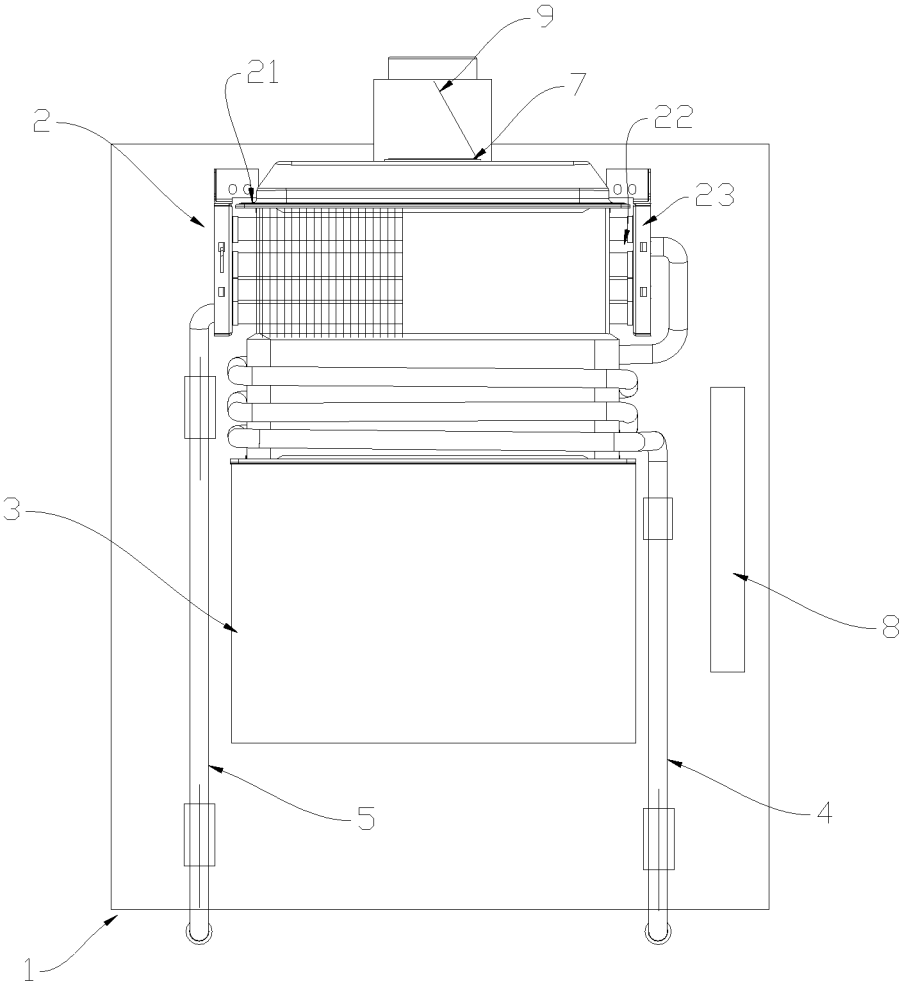
FIG. 1 illustrates a diagrammatic view of an ignition temperature control apparatus of a gas water heater of one embodiment of the present disclosure.

1. housing; 2. heat exchanger; 21. enclosure frame; 22. heat exchanging pipe; 23. water collection box; 3. combustion device; 4. water inlet pipe; 5. water outlet pipe; 6. first temperature detection device; 7. exhaust pipe; 8. controller; 9. wind cap; 10. electrically heating element; 11. temperature control part; 12. second temperature detection device.

DETAILED DESCRIPTION OF THE EMBODIMENT

The details of the present disclosure will be understood more clearly with reference to accompanying drawings and the description of the detailed embodiments of the present disclosure. However, the detailed embodiments of the present disclosure described herein are only used for the purpose of explaining the present disclosure, and should not be understood as limitations to the present disclosure in any way. Being taught by the present disclosure, a person skilled in the art will conceive of any possible modification based on the present disclosure, which shall be regarded as falling within the scope of the present disclosure.

The present disclosure discloses an ignition temperature control apparatus of a gas water heater, comprising: a heat exchanger 2 made of stainless steel; a combustion device 3 which supplies high-temperature flue gas to the heat exchanger 2; a water passage communicated with the heat exchanger 2; a first temperature detection device 6 provided on the heat exchanger 2 or on the water passage; and a controller 8, which controls the combustion device 3 to operate in such a state that a requirement for thermal bearing capacity of the heat exchanger 2 made of stainless steel is satisfied if a temperature detected by the first temperature detection device 6 is lower than or equal to a first preset temperature or a rate of decline of a temperature detected by the first temperature detection device 6 is higher than or equal to a first preset value.

In the embodiment of the present disclosure, the heat exchanger 2 is made of stainless steel. As compared with copper, stainless steel has a better thermal inertia, i.e., the surface of the heat exchanger 2 made of stainless steel has a small temperature change when a certain amount of heat is applied thereto within a certain period. Thus the surface of the heat exchanger 2 made of stainless steel has a small temperature fluctuation. As a result, the heat exchanger 2 made of stainless steel has a longer service life than the heat exchanger 2 made of copper. Meanwhile, since stainless steel has a lower thermal conductivity coefficient (the thermal conductivity coefficient of stainless steel is 16W/m*K, and the thermal conductivity coefficient of copper is 377 W/m*K), the heat exchanger 2 made of stainless steel has better thermal insulation properties. In addition, since stainless steel has a lower thermal conductivity coefficient, under the stop state, the heat exchanger 2 made of stainless steel can make the water temperature in the heat exchanger 2 rise slowly, rather than instantly, when the combustion device 3 is started with a preset output load. In that case, even if the user turns on the ignition temperature control apparatus of the gas water heater, the temperature of water flowing out of the ignition temperature control apparatus of the gas water heater still does not exceed the user's requirement.

In this embodiment, if a temperature detected by the first temperature detection device 6 is lower than or equal to a first preset temperature or a rate of decline of a temperature detected by the first temperature detection device 6 is higher than or equal to a first preset value, the controller 8 controls the combustion device 3 to operate in such a state that a requirement for thermal bearing capacity of the heat exchanger 2 made of stainless steel is satisfied. In the embodiment of the present disclosure, "the combustion device 3 operates in such a state that a requirement for thermal bearing capacity of the heat exchanger 2 made of stainless steel is satisfied" may be understood as that the output load and the operating time of the combustion device 3 are within a certain range required, in which the heat exchanger 2 made of stainless steel will not be damaged by the absorbed heat, i.e., the heat exchanger 2 made of stainless steel is bearable to the heat output thereto from the combustion device 3. Preferably, if the temperature detected by the first temperature detection device 6 is lower than or equal to the first preset temperature or the rate of decline of the temperature detected by the first temperature detection device 6 is higher than or equal to the first preset value, the controller 8 controls the combustion device 3 to operate in such a state as to satisfy the requirement that a temperature of surface of the heat exchanger 2 made of stainless steel is lower than or equal to 300° C.

In a preferred embodiment, the controller 8 controls the combustion device 3 to operate in a certain output load if the temperature detected by the first temperature detection device 6 is lower than or equal to the first preset temperature or the rate of decline of a temperature detected by the first temperature detection device 6 is higher than or equal to the first preset value. In a case where the requirement for thermal bearing capacity of the heat exchanger 2 made of stainless steel is satisfied, the combustion device 3 can operate in a large output load, so that the heat exchanger 2 absorbs enough heat as soon as possible to ensure that the water temperature in the heat exchanger 2 is kept above the freezing temperature for a long time. In addition, when the large load is output, the flame generated by the combustion device 3 can be prevented from being extinguished by the wind flowing backward from the exit of the exhaust pipe. Meanwhile, the controller 8 keeps the output load of the combustion device 3 within a certain range, so that a water temperature in the heat exchanger 2 is always below a seventh preset temperature (e.g., lower than or equal to 60° C.). Thus when the user wants to use water at that time, the temperature of water obtained by the user meets the requirement.

In particular, the combustion device 3 may operate in an anti-freezing work mode. If the temperature detected by the first temperature detection device 6 is lower than or equal to the first preset temperature or the rate of decline of the temperature detected by the first temperature detection device 6 is higher than or equal to the first preset value, the combustion device 3 operates in the anti-freezing work mode with an operating time of 5s to 20s and an output load of 10 kw to 18 kw. In the anti-freezing work mode, the combustion device 3 can operate for a long time with a small output load, which not only ensures that the heat exchanger 2 made of stainless steel will not be damaged, but also keeps the temperature of the water in the water collection box and the heat exchanging pipe 22 above the freezing temperature for a long time, thereby preventing the heat exchanger 2 from being frozen and enabling the temperature of water in the heat exchanger 2 to better meet the requirement for a long time.

Figure 2:
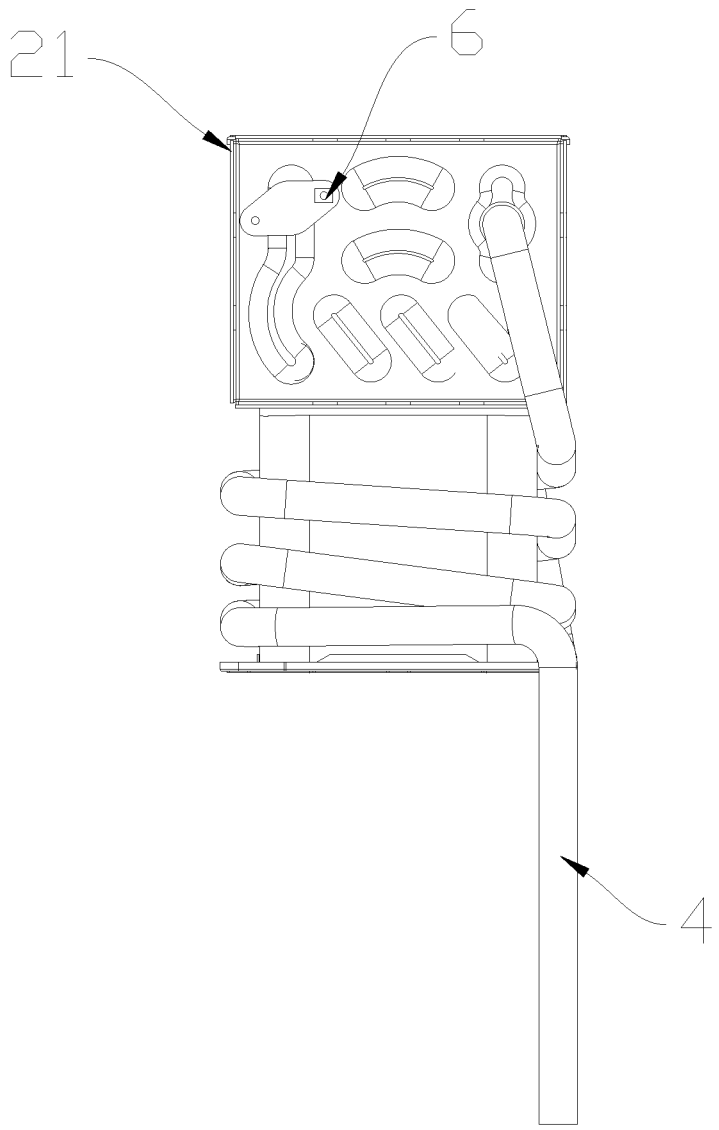
FIG. 2 illustrates a side view of FIG. 1.

FIGS. 1 and 2 illustrate a particular embodiment of the present disclosure. Referring to FIGS. 1 and 2, an ignition temperature control apparatus of a gas water heater comprises a housing 1, a heat exchanger 2, a combustion device 3, a water passage, a first temperature detection device 6, an exhaust pipe 7 and a controller 8.

In this embodiment, the water passage comprises water inlet and outlet pipes 4, 5 connected to the heat exchanger 2. The heat exchanger 2, the combustion device 3, the water inlet pipe 4, the water outlet pipe 5, the first temperature detection device 6, and the controller 8 may be provided in the housing 1. The heat exchanger 2 comprises an enclosure frame 21, a plurality of heat exchanging pipes 22 disposed through the enclosure frame 21, and a water collection box 23 communicated with ends of the heat exchanging pipes 22 that protrude out of the enclosure frame 21 to connect the plurality of heat exchanging pipes 22 into a continuous flow path. After ignition and operation, the combustion device 3 generates high-temperature flue gas to heat the heat exchanger 2. The water inlet pipe 4 and the water outlet pipe 5 are communicated with the heat exchanger 2, respectively. The exhaust pipe 7 is provided downstream the heat exchanger 2 to discharge cooled flue gas after the heat exchange.

In this embodiment, the enclosure frame 21, the heat exchanging pipe 22, and the water collection box 23 of the heat exchanger 2 are all made of stainless steel. As described above, the surface of the heat exchanger 2 made of stainless steel has a small temperature fluctuation and good thermal insulation properties, which not only ensures that the heat exchanger 2 will not be damaged when the combustion device 3 is started in the stop state, but also keeps the water temperatures in the heat exchanging pipe 22 above the freezing temperature for a long time after the combustion device 3 stops the operation.

In this embodiment, referring to FIG. 2, the first temperature detection device 6 may be provided on an outer wall of the water collection box 23. The controller 8 is electrically connected to the first temperature detection device 6 and the combustion device 3. Since the water collection box 23 needs to communicate the heat exchanging pipes 22 with each other, there are quite a few connection points, so that the water collection box 23 has a low strength, and can be easily damaged by being frozen.

Of course, in an optional embodiment, the first temperature detection device 6 may be provided on the outer wall that is adjacent to the heat exchanging pipe 22. When the combustion device 3 of the ignition temperature control apparatus of the gas water heater stops operating, cold wind in the external environment may flow backward into the heat exchanger 2, and the temperature at the enclosure frame 21 of the heat exchanger 2 will quickly decrease to cause the heat exchanging pipe 22 to be frozen. Since the enclosure frame 21 adjacent to the heat exchanging pipe 22 is at a short distance from the heat exchanging pipe 22, the enclosure frame 21 can respond to the temperature change of the heat exchanging pipe 22 in time.

In this embodiment, if the temperature detected by the first temperature detection device 6 is lower than the first preset temperature (e.g., 4° C. to 6° C., such as 5° c.), the controller 8 causes the ignition and operation of the combustion device 3, and enables the combustion device 3 to operate in such a state that the requirement for thermal bearing capacity of the heat exchanger 2 made of stainless steel is satisfied. In this embodiment, is the first temperature detection device 6 detects a temperature lower than 5° C., as to the gas water heater of 12 liters, the controller 8 may control the combustion device 3 to operate with an output load of 11 kw to 14 kw. Of course, in other optional embodiments, the controller 8 may control the combustion device 3 to operate with other output loads, which is not limited herein. For example as to the gas water heater of 13 liters, the controller 8 may control the combustion device 3 to operate with an output load of 14 kw to 16 kw. In other optional embodiments, the controller 8 may control the combustion device 3 to operate with an output load of 16 kw to 18 kw.

If the temperature detected by the first temperature detection device 6 is lower than or equal to the first preset temperature or the rate of decline of the temperature detected by the first temperature detection device 6 is higher than or equal to the first preset value, the controller 8 controls the combustion time of the combustion device 3 to increase as the output load decreases, so as to prevent the heat exchanger 2 from being damaged by absorbing too much heat.

In this embodiment, if the temperature detected by the first temperature detection device 6 is lower than or equal to the first preset temperature or the rate of decline of the temperature detected by the first temperature detection device 6 is higher than or equal to the first preset value, the water in the heat exchanger 2 is in a still state in a case where the ignition temperature control apparatus of the gas water heater is in the stop state. As compared with the operation of the ignition temperature control apparatus of the gas water heater in a normal water use state, the heat generated by the combustion device 3 when the water in the heat exchanger 2 is in a still state has a large influence on the heat exchanger 2, thus the thermal bearing capacity of the heat exchanger 2 when the combustion device 3 is started in the stop state shall be considered, so as to prevent the heat exchanger 2 from being damaged in that stage. In particular, since copper has a very large thermal conductivity coefficient, the heat exchanger 2 at least partially made of copper may probably be damaged when the combustion device 3 is started in the stop state.

In an optional embodiment, if the rate of decline of the temperature detected by the first temperature detection device 6 is higher than or equal to the first preset value, such as being higher than 19° C./h to 21° C./h (e.g., 20° C./h), the controller 8 controls the combustion device 3 to operate in such a state that the requirement for thermal bearing capacity of the heat exchanger 2 made of stainless steel is satisfied.

In a preferred embodiment, the controller 8 may control the combustion device 3 according to either of the facts whether the temperature detected by the first temperature detection device 6 is lower than or equal to first preset temperature and whether the rate of decline of the temperature detected by the first temperature detection device 6 is higher than or equal to the first preset value. That is to say, once the temperature detected by the first temperature detection device 6 is lower than or equal to first preset temperature, or the rate of decline of the temperature detected by the first temperature detection device 6 is higher than or equal to the first preset value, the controller starts the combustion device 3 to operate in such a state that the requirement for thermal bearing capacity of the heat exchanger 2 made of stainless steel is satisfied.

In a preferred embodiment, the combustion device 3 comprises a plurality of burner rows (for example, ten burner rows). If the temperature detected by the first temperature detection device 6 is lower than or equal to first preset temperature, or the rate of decline of the temperature detected by the first temperature detection device 6 is higher than or equal to the first preset value, the controller 8 controls all of the ten burner rows to start combustion, thereby uniformly heating the heat exchanging pipe 22 and preventing the heat exchanging pipe 22 from being damaged by non-uniform heating.

In a preferred embodiment, referring to FIG. 1, the exhaust passage or the exit of the exhaust pipe 7 may be provided with a wind cap 9, which can cause a degree of opening of the exhaust pipe 7 to be lower than or equal to 10% when the combustion device 3 is in the stop state, so as to reduce cold wind flowing backward from the exhaust pipe 7 as much as possible, and avoid the heat exchanger 2 from being damaged. By using the wind cap 9 of such a structure, the heat loss can be reduced after the operation of the combustion device 3 is finished, and a good thermal insulation effect is achieved for the heat exchanger 2. In this embodiment, one side of the wind cap 9 is hinged with the exhaust pipe 7. Of course, in other optional embodiments, the wind cap 9 may be of any other feasible structure. In a more preferred embodiment, when the combustion device 3 is in the stop state, the wind cap 9 can completely block the exhaust pipe 7.

Figure 3:
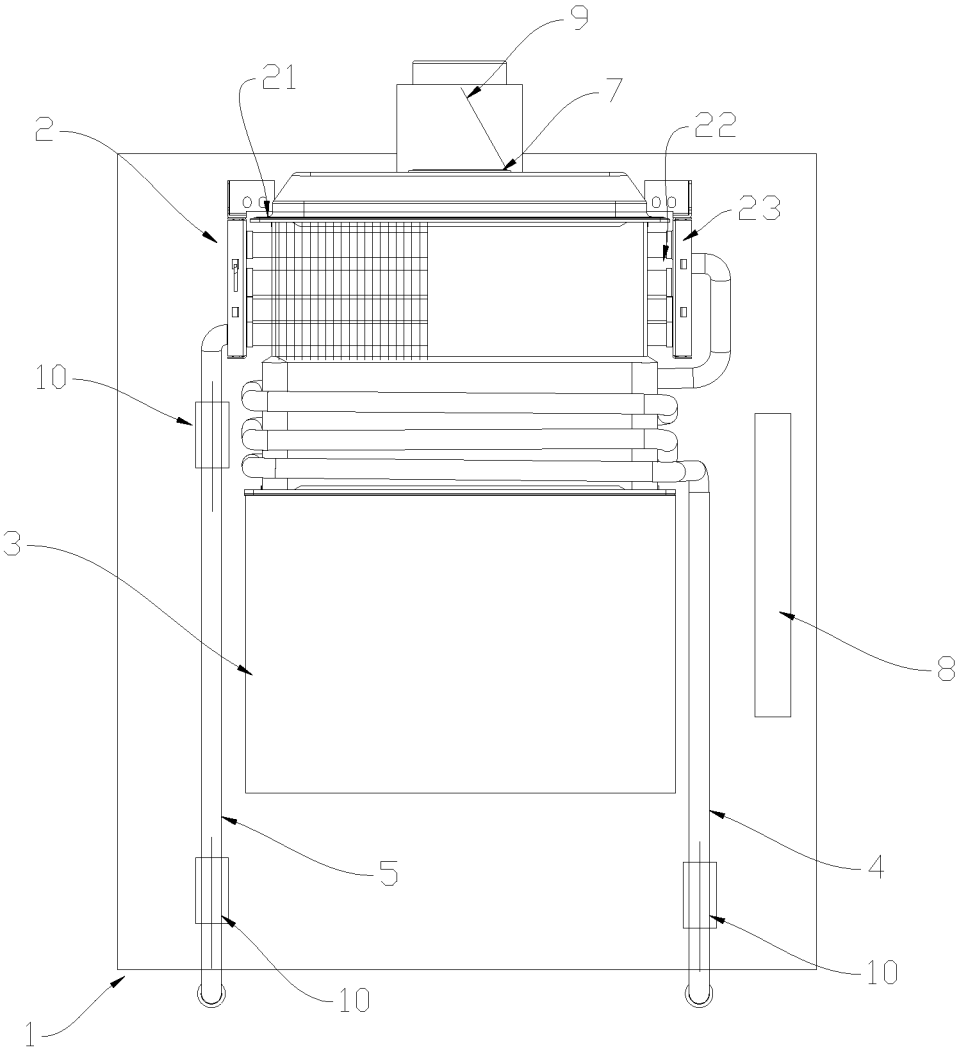
FIG. 3 illustrates a diagrammatic view of an ignition temperature control apparatus of a gas water heater of another embodiment of the present disclosure.

FIG. 3 illustrates another particular embodiment in the present disclosure. Referring to FIG. 3, as described above, an ignition temperature control apparatus of a gas water heater comprises a housing 1, a heat exchanger 2, a combustion device 3, a water inlet pipe 4, a water outlet pipe 5, a first temperature detection device 6, an exhaust pipe 7, an electrically heating element 10, and a controller 8. In this embodiment, the first temperature detection device 6 may be provided on the heat exchanger 2, or on the water inlet pipe 4 and/or the water outlet pipe 5. In order to prevent the water inlet pipe 4 and/or the water outlet pipe 5 and/or the heat exchanger 2 from being frozen, the electrically heating element 10 may be provided at one or more places on the water inlet pipe 4 or the water outlet pipe 5 or the heat exchanger 2. In this embodiment, the electrically heating element 10 is provided on the water inlet pipe 4, the water outlet pipe 5 and the heat exchanger 2. If a temperature detected by the first temperature detection device 6 is lower than or equal to a first preset temperature or a rate of decline of a temperature detected by the first temperature detection device 6 is higher than or equal to a first preset value, the controller 8 may put the electrically heating element 10 in an operating state, so as to heat a portion where the electrically heating element 10 is located (e.g., a portion of the water inlet pipe 4, of the water outlet pipe 5 or of the heat exchanger 2 that is adjacent to the combustion device 3).

In this embodiment, if a temperature detected by the first temperature detection device 6 is lower than or equal to a first preset temperature or a rate of decline of a temperature detected by the first temperature detection device 6 is higher than or equal to a first preset value, the controller 8 may start the electrically heating element 10 and the combustion device 3 at the same time, and control the combustion device 3 to operate in such a state that the requirement for thermal bearing capacity of the heat exchanger made of stainless steel is satisfied. Of course, the order and rule for the controller 8 to control the electrically heating element 10 and the combustion device 3 to start may be determined upon the actual demand.

For example, in other optional embodiment, if a temperature detected by the first temperature detection device 6 is lower than or equal to a first preset temperature or a rate of decline of a temperature detected by the first temperature detection device 6 is higher than or equal to a first preset value, the controller 8 may first start the combustion device 3, and then control the electrically heating element 10 to be in an operating state after the combustion device 3 is started for a certain time.

For another example, in other optional embodiments, if a temperature detected by the first temperature detection device 6 is lower than or equal to a first preset temperature or a rate of decline of a temperature detected by the first temperature detection device 6 is higher than or equal to a first preset value, the controller 8 may first control the electrically heating element 10 to be in an operating state, and then starts the combustion device 3 after the electrically heating element 10 is in the operating state for a certain time.

When being in operation, the combustion device 3 can supply more heat to the portions of the water collection box 23 and the enclosure frame 21 adjacent to the heat exchanging pipe 22, while supplying less heat to the water inlet pipe 4 and the water outlet pipe 5. In a preferred embodiment, in order to prevent the water inlet pipe 4 or the water outlet pipe 5 from being frozen, the electrically heating element 10 may be provided thereon.

Figure 4:
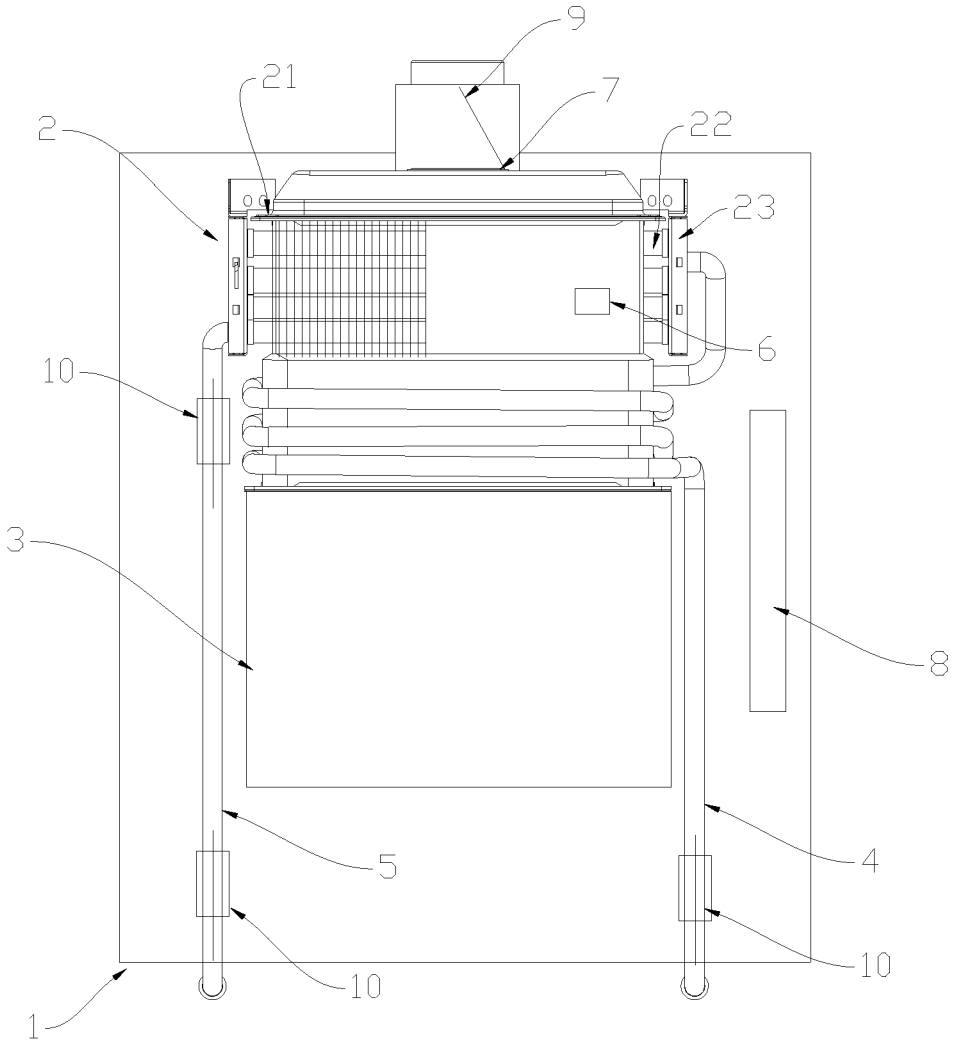
FIG. 4 illustrates a diagrammatic view of an ignition temperature control apparatus of a gas water heater of another embodiment of the present disclosure.

In a more preferred embodiment, referring to FIG. 4, the first temperature detection device 6 is provided on the water collection box 23 or a portion of the enclosure frame 21 which is adjacent to the heat exchanging pipe 22 (in FIG. 4, the first temperature detection device 6 is provided on a portion of enclosure frame 21 which is adjacent to the heat exchanging pipe 22). The electrically heating element 10 is provided on the water inlet pipe 4, the water outlet pipe 5, and a portion of the heat exchanger 2 that is adjacent to the combustion device 3. If a temperature detected by the first temperature detection device 6 is lower than or equal to a second preset temperature (e.g., 9° C. to 11° C., such as 10° C.) or a rate of decline of a temperature detected by the first temperature detection device 6 is higher than or equal to a second preset value (e.g., 15° C./h to 17° C./h, such as 16° C./h), the controller 8 controls the electrically heating element 10 to be in an operating state, and controls the combustion device 3 to be in a stop state, wherein the second preset temperature is higher than or equal to the first preset temperature, and the second preset value is lower than or equal to the first preset value. The controller 8 may first heat the water inlet pipe 4, the water outlet pipe 5, and a portion of the heat exchanger 2 that is adjacent to the combustion device 3 by means of the electrically heating element 10, and acts on other parts of the heat exchanger 2 by means of the water inlet pipe 4, the water outlet pipe 5, and the portion of the heat exchanger 2 that is adjacent to the combustion device 3. If the temperature further detected by the first temperature detection device 6 decreases to be lower than or equal to the first preset temperature, or the rate of decline of the temperature detected by the first temperature detection device 6 increases to be higher than or equal to the first preset value, the controller 8 controls the combustion device 3 to operate in such a state that the requirement for thermal bearing capacity of the heat exchanger 2 made of stainless steel is satisfied, thereby acting on the heat exchanger 2 by starting the combustion device 3.

Figure 5:
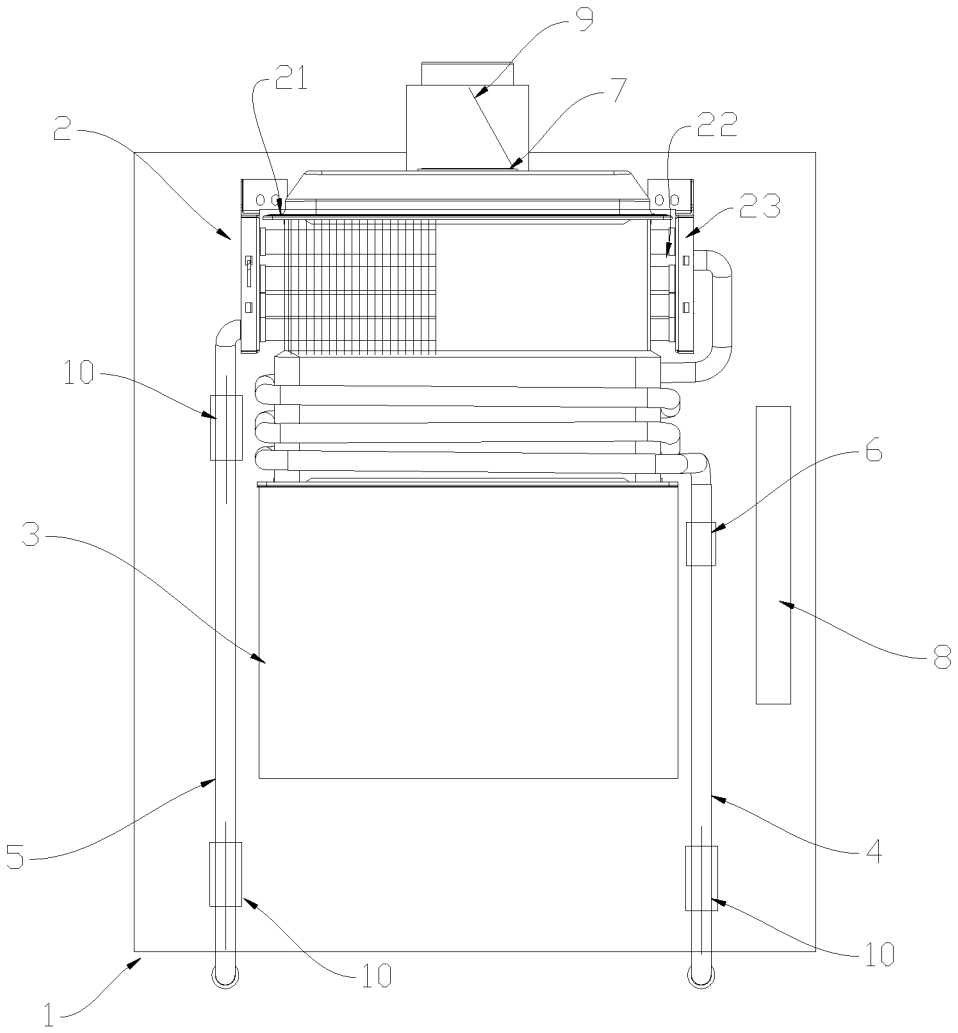
FIG. 5 illustrates a diagrammatic view of an ignition temperature control apparatus of a gas water heater of another embodiment of the present disclosure.

In a more preferred embodiment, referring to FIG. 5, the ignition temperature control apparatus of the gas water heater comprises an electrically heating element 10 and the first temperature detection device 6 that are provided on the water inlet pipe 4 and/or the water outlet pipe 5. If the temperature detected by the first temperature detection device 6 is lower than or equal to the first preset temperature or the rate of decline of that temperature is higher than or equal to the first preset value, the controller 8 controls the combustion device 3 to operate in such a state that the requirement for thermal bearing capacity requirement of the heat exchanger 2 made of stainless steel is satisfied, thereby acting on the heat exchanger 2 by starting the combustion device 3. The controller 8 may first acts on the heat exchanger 2 by means of the combustion device 3. When the action on the water inlet pipe 4 or the water outlet pipe 5 by means of the combustion device 3 is not enough, the water inlet pipe 4 and the water outlet pipe 5 may be frozen. In that case, if a temperature further detected by the first temperature detection device 6 decreases to be lower than or equal to a third preset temperature (e.g., 5° C. to 7° C., such as 6° C.) or the rate of decline of a temperature further detected by the first temperature detection device 6 is higher than or equal to a third preset value (e.g., 23° C./h to 25° C./h, such as 24° C./h), the controller 8 controls the electrically heating element 10 to be in an operating state, wherein the third preset temperature is lower than or equal to the first preset temperature, and the third preset value is higher than the first preset value. The controller 8 may heat the water inlet pipe 4 and/or the water outlet pipe 5 by means of the electrically heating element 10 to prevent freezing.

Figure 6:
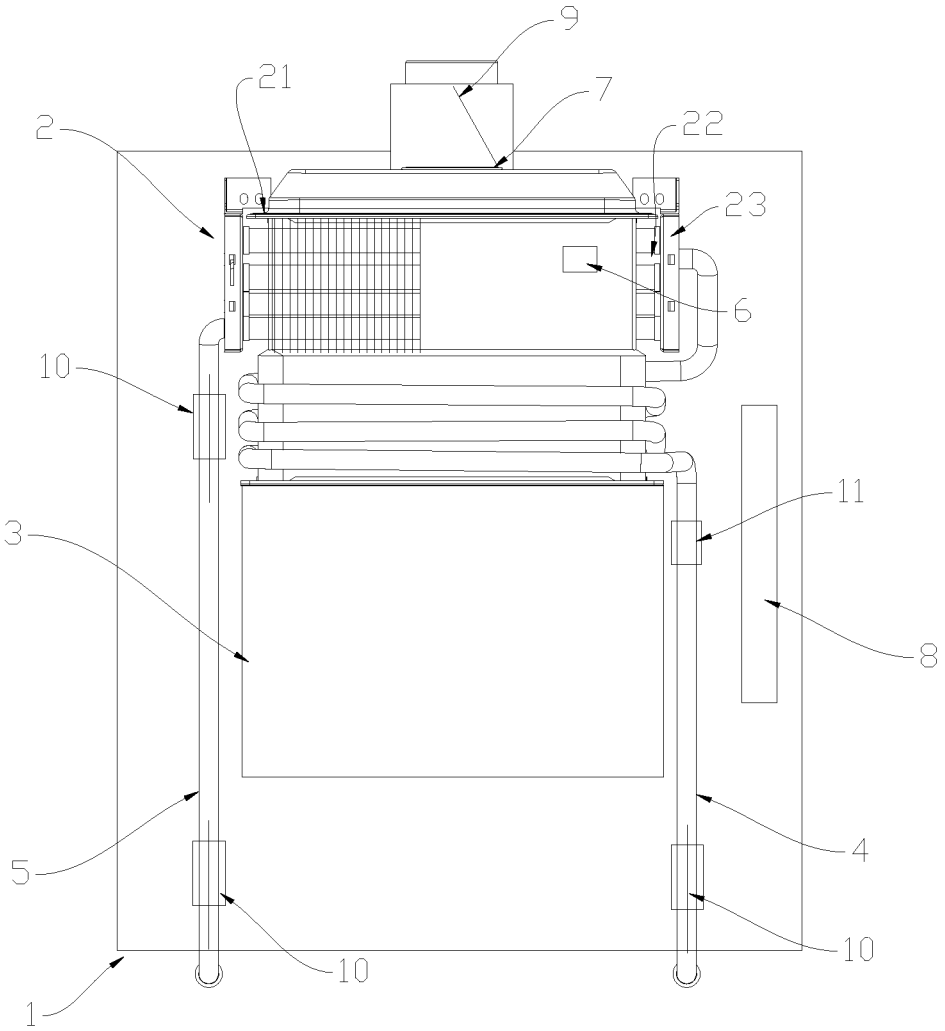
FIG. 6 illustrates a diagrammatic view of an ignition temperature control apparatus of a gas water heater of another embodiment of the present disclosure.

FIG. 6 illustrates an ignition temperature control apparatus of a gas water heater of another optional embodiment of the present disclosure. Referring to FIG. 6, as described above, the ignition temperature control apparatus of the gas water heater comprises a housing 1, a heat exchanger 2, a combustion device 3, a water inlet pipe 4, a water outlet pipe 5, a first temperature detection device 6, an exhaust pipe 7, and a controller 8. The heat exchanger 2 comprises an enclosure frame 21, a plurality of heat exchanging pipes 22 disposed through the enclosure frame 21, and a water collection box 23 communicated with ends of the heat exchanging pipes 22 that protrude out of the enclosure frame 21 to connect the plurality of heat exchanging pipes 22 into a continuous flow path. The first temperature detection device 6 is provided on the water collection box 23 or on the enclosure frame 21 that is adjacent to the heat exchanging pipe 22 (in FIG. 6, the first temperature detection device 6 is provided on the enclosure frame 21 that is adjacent to the heat exchanging pipe 22). If a temperature detected by the first temperature detection device 6 is lower than or equal to a first preset temperature or a rate of decline of a temperature detected by the first temperature detection device 6 is higher than or equal to a first preset value, the controller 8 controls the combustion device 3 to operate in such a state that the requirement for thermal bearing capacity of the heat exchanger 2 made of stainless steel is satisfied.

The ignition temperature control apparatus of the gas water heater further comprises an electrically heating element 10 and a driving circuit enabling the electrically heating element 10 to operate. The driving circuit comprises a temperature control part 11 that is provided on the water inlet pipe 4, the water outlet pipe 5, and/or a portion of the heat exchanger 2 that is adjacent to the combustion device 3, and the temperature control part 11 is capable of enabling the driving circuit to be switched on if a temperature at a position where the temperature control part 11 is located is lower than or equal to a fourth preset temperature (e.g., 5° C. to 7° C., such as 6° C.). If the temperature at the temperature control part 11 is lower than or equal to the fourth preset temperature, the temperature control part 11 switches on the driving circuit, thereby turning on the electrically heating element 10. In that case, the electrically heating element 10 can heat at the position thereof. In a preferred embodiment, the electrically heating element 10 may be located on the water inlet pipe 4 and/or the water outlet pipe 5, so as to heat the water inlet pipe 4 and the water outlet pipe 5 which cannot be acted on directly by the combustion device 3. Of course, in other optional embodiments, the electrically heating element 10 may be at any other required position, such as a portion of the heat exchanger 2 that is adjacent to the combustion device 3. Specifically, the temperature control part 11 is a temperature control relay in this embodiment.

Figure 7:
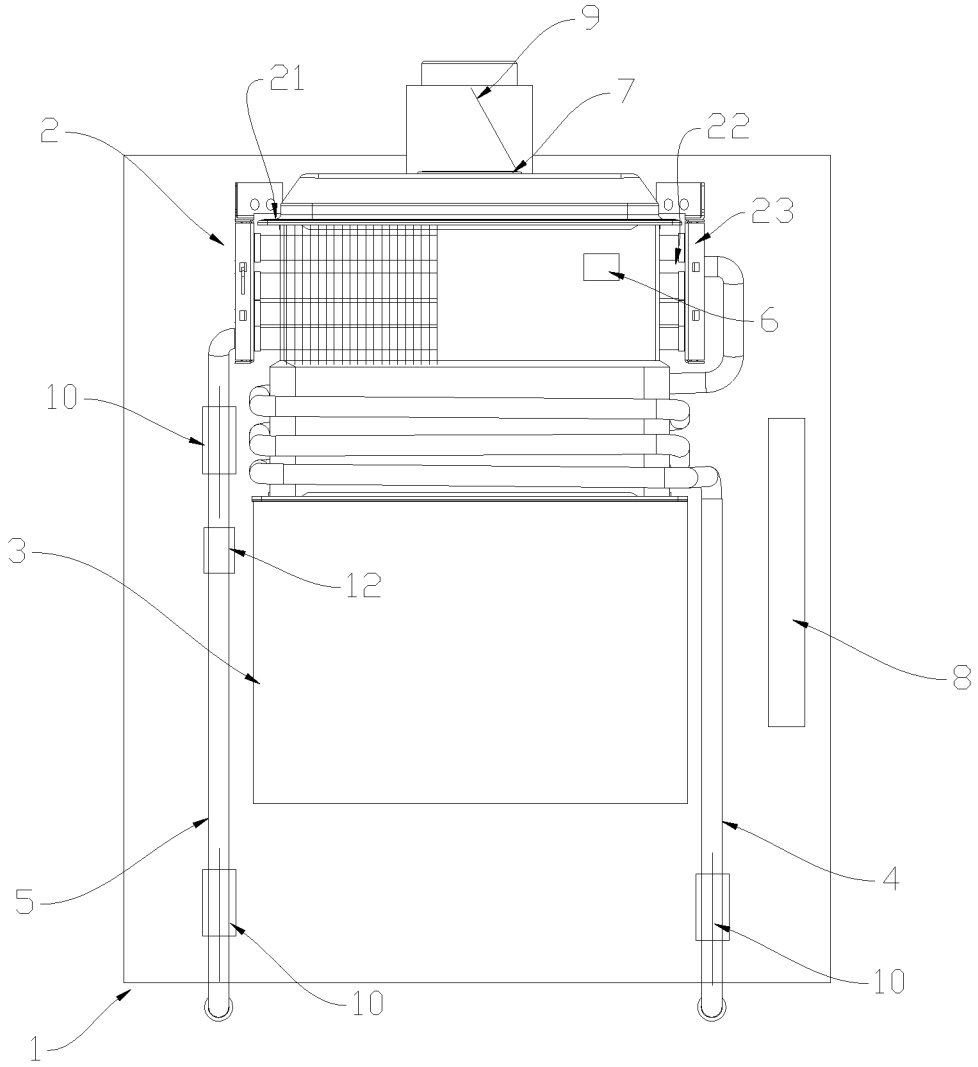
FIG. 7 illustrates a diagrammatic view of an ignition temperature control apparatus of a gas water heater of another embodiment of the present disclosure.

FIG. 7 illustrates an ignition temperature control apparatus of a gas water heater of another optional embodiment of the present disclosure. Referring to FIG. 7, as described above, the ignition temperature control apparatus of the gas water heater comprises a housing 1, a heat exchanger 2, a combustion device 3, a water inlet pipe 4, a water outlet pipe 5, a first temperature detection device 6, an exhaust pipe 7, and a controller 8. The heat exchanger 2 comprises an enclosure frame 21, a plurality of heat exchanging pipes 22 disposed through the enclosure frame 21, and a water collection box 23 communicated with ends of the heat exchanging pipes 22 that protrude out of the enclosure frame 21 to connect the plurality of heat exchanging pipes 22 into a continuous flow path. The first temperature detection device 6 is provided on the water collection box 23 or on the enclosure frame 21 that is adjacent to the heat exchanging pipe 22 (in FIG. 7, the first temperature detection device 6 is provided on the enclosure frame 21 that is adjacent to the heat exchanging pipe 22). A portion of the heat exchanger 2 that is adjacent to the combustion device 3, and/or the water inlet pipe 4, and/or the water outlet pipe 5 are provided with a second temperature detection device 12 and an electrically heating element 10.

If a temperature detected by the first temperature detection device 6 is lower than or equal to a first preset temperature or a rate of decline of a temperature detected by the first temperature detection device 6 is higher than or equal to a first preset value, the controller 8 controls the combustion device 3 to operate in such a state that the requirement for thermal bearing capacity of the heat exchanger 2 made of stainless steel is satisfied, and further controls the electrically heating element 10 to be in a working state.

If a temperature detected by the second temperature detection device 12 is lower than or equal to a fifth preset temperature (e.g., 7° C. to 9° C., such as 8° C.) or a rate of decline of a temperature detected by the first temperature detection device 12 is higher than or equal to a fifth preset value (e.g., 23° C./h to 25° C./h, such as 24° C./h), the controller 8 may control the electrically heating element 10 to be in an operating state. In an optional embodiment, If a temperature detected by the second temperature detection device 12 is lower than or equal to a fifth preset temperature or a rate of decline of a temperature detected by the first temperature detection device 12 is higher than or equal to a fifth preset value, the controller 8 may control the electrically heating element 10 to be in an operating state, and control the combustion device 3 to operate in such a state that the requirement for thermal bearing capacity of the heat exchanger 2 made of stainless steel is satisfied. Upon the actual demand, if a temperature detected by the second temperature detection device 12 is lower than or equal to a fifth preset temperature or a rate of decline of a temperature detected by the first temperature detection device 12 is higher than or equal to a fifth preset value, the controller 8 may control the electrically heating element 10 and the combustion device 3 to start at the same time; the controller 8 may also first start the combustion device 3, and then control the electrically heating element 10 to be in an operating state; or the controller 8 may first control the electrically heating element 10 to be in an operating state, and then start the combustion device 3.

In a more preferred embodiment, if a temperature detected by the second temperature detection device 12 is lower than or equal to a sixth preset temperature (e.g., 9° C. to 11° C., such as 10° C.) or a rate of decline of a temperature detected by the first temperature detection device 12 is higher than or equal to a sixth preset value (e.g., 19° C./h to 21° C./h, such as 20° C./h), the controller 8 controls the combustion device 3 to operate in such a state that the requirement for thermal bearing capacity for the heat exchanger 2 made of stainless steel is satisfied, wherein the sixth preset temperature is higher than or equal to the fifth preset temperature, and the sixth preset value is lower than or equal to the fifth preset value. The controller 8 may first act on the heat exchanger 2 by means of the combustion device 3. When the action on the water inlet pipe 4 or the water outlet pipe 5 by the controller 8 by means of the combustion device 3 is not enough, the water inlet pipe 4 and the water outlet pipe 5 may be frozen. In that case, if a temperature further detected by the second temperature detection device 12 decreases to be lower than or equal to a fifth preset temperature or a rate of decline of a temperature further detected by the second temperature detection device 12 is higher than or equal to a fifth preset value, the controller 8 controls the electrically heating element 10 to be in an operating state. The controller 8 may heat the water inlet pipe 4 and/or the water outlet pipe 5 by means of the electrically heating element 10 to prevent freezing.

Figure 8A:
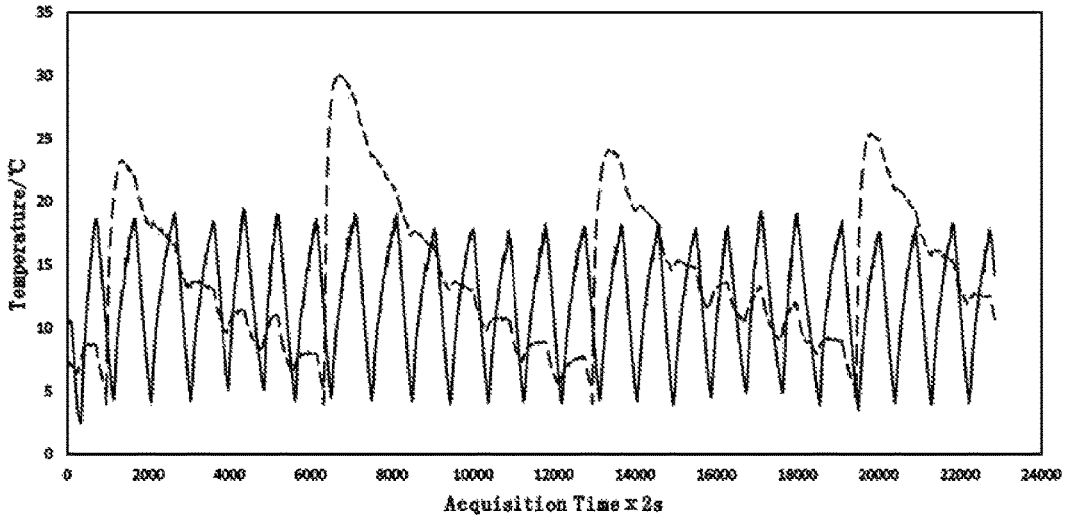
FIG. 8*a* illustrates an effect diagram in another embodiment of the present disclosure.
Figure 8B:
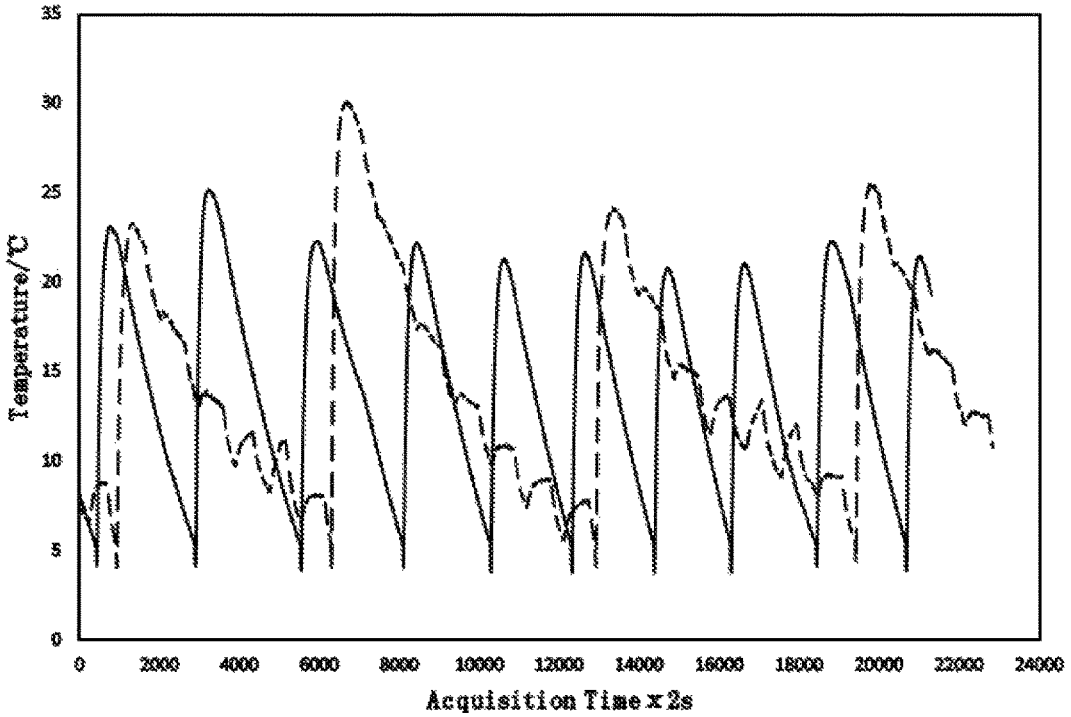
FIG. 8*b* illustrates a temperature curve comparison diagram.

FIG. 8*a* illustrates an effect diagram of one embodiment of the present disclosure. In this embodiment, the first temperature detection device 6 is provided on the water collection box 23, and the electrically heating element 10 and the second temperature detection device 12 are provided on the water inlet pipe 4 and the water outlet pipe 5. As illustrated in FIG. 8*a*, the dotted line is the data curve detected by the first temperature detection device 6, and the solid line is the data curve detected by the second temperature detection device 12. If an environment temperature is about −20° C. and a temperature detected by the first temperature detection device 6 is lower than 5° C., the controller 8 controls the combustion device 3 to operate in such a state that the requirement for thermal bearing capacity of the heat exchanger 2 made of stainless steel is satisfied. While the controller 8 controls the combustion device 3 to start for heating and anti-freezing, the controller 8 controls the electrically heating element 10 to be in an operating state If a temperature detected by the second temperature detection device 12 is lower than 5° C. When the electrically heating element 10 generates heat at the position thereof, the heated water will flow toward the heat exchanger through convection. Since the water of a high temperature continuously flows into the heat exchanger, the water temperature in the heat exchanger can be preserved, and the time for which the temperature of the heat exchanger 22 decreases to the first preset temperature is prolonged. FIG. 8*b* illustrates a temperature curve comparison diagram between the embodiment of FIG. 8*a* and the embodiment in which an ignition temperature control apparatus of a gas water heater is not provided with the electrically heating element 10, wherein the solid line is the data curves detected by the first temperature detection device of the ignition temperature control apparatus not provided with the electrically heating element 10, and the dotted line is the data curves detected by the first temperature detection device of the ignition temperature control apparatus provided with the electrically heating element. As can be seen from FIG. 8*b*, after the ignition for combustion of the combustion device for 10 seconds, the ignition temperature control apparatus of the gas water heater provided with the electrically heating element 10 (i.e., the embodiment of FIG. 8*a*) can keep a temperature of the position where the first temperature detection device 6 is located above 5° C. for a duration two times of that of the ignition temperature control apparatus of the gas water heater not provided with the electrically heating element 10. It is clear that the heat generated by the electrically heating element 10 can partially act on the water in the heat exchanger 2. Thus by using the combustion device 3 for heating and anti-freezing in coordination with the operation of the electrically heating element 10, the thermal insulation time of the heat exchanger 2 can be well prolonged, and the starting frequency of the combustion device 3 of the ignition temperature control apparatus of the gas water heater can be decreased.

A gas water heater comprises the above ignition temperature control apparatus.

The embodiments herein are all described in a progressive manner, and the contents highlighted in each embodiment are distinctions relative to other embodiments, while the same or similar portions of the embodiments can refer to each other. The above embodiments are merely used for illustrating the technical concept and features of the present disclosure, with a purpose that a person skilled in the art can acquire the content of the present disclosure and accordingly implement the same, rather than limiting the protection scope of the present disclosure. Any equivalent variation or modification made according to the essential spirit of the present disclosure shall fall within the protection scope of the present disclosure.

The invention claimed is:

1. An ignition temperature control apparatus of a gas water heater, comprising: a heat exchanger made of stainless steel; a combustion device which supplies high-temperature flue gas to the heat exchanger; a water passage communicated with the heat exchanger; a first temperature detection device provided on the heat exchanger or on the water passage; and a controller, wherein when the ignition temperature control apparatus of the gas water heater is in a stop state, if a temperature detected by the first temperature detection device is lower than or equal to a first preset temperature or a rate of decline of a temperature detected by the first temperature detection device is higher than or equal to a first preset value, the controller controls the combustion device to operate in such a state that a requirement for thermal bearing capacity of the heat exchanger made of stainless steel is satisfied.

2. The ignition temperature control apparatus of the gas water heater according to claim 1, wherein the heat exchanger comprises: an enclosure frame; a plurality of heat exchanging pipes disposed through the enclosure frame; and a water collection box communicated with ends of the heat exchanging pipes that protrude out of the enclosure frame to connect the plurality of heat exchanging pipes into a continuous flow path, and wherein the first temperature detection device is provided on the water collection box or on the enclosure frame adjacent to the heat exchanging pipes.

3. The ignition temperature control apparatus of the gas water heater according to claim 1, wherein the ignition temperature control apparatus of the gas water heater comprises an exhaust pipe that is provided downstream the heat exchanger, the exhaust pipe being provided at an exhaust passage or an exit thereof with a wind cap; and wherein when the combustion device is in a stop state, the wind cap can cause a degree of opening of the exhaust pipe to be lower than or equal to 10%.

4. The ignition temperature control apparatus of the gas water heater according to claim 1, wherein the combustion device includes a plurality of burner rows, and wherein if the temperature detected by the first temperature detection device is lower than or equal to the first preset temperature or the rate of decline of the temperature detected by the first temperature detection device is higher than or equal to the first preset value, the controller controls all of the burner rows to start combustion.

5. The ignition temperature control apparatus of the gas water heater according to claim 1, wherein an electrically heating element is provided on the water passage and/or the heat exchanger.

6. The ignition temperature control apparatus of the gas water heater according to claim 5, wherein if the temperature detected by the first temperature detection device is lower than or equal to the first preset temperature or the rate of decline of the temperature detected by the first temperature detection device is higher than or equal to the first preset value, the controller controls the electrically heating element and the combustion device to start at the same time; the controller first starts the combustion device, and then controls the electrically heating element to be in an operating state; or the controller first controls the electrically heating element to be in an operating state, and then starts the combustion device.

7. The ignition temperature control apparatus of the gas water heater according to claim 1, wherein the heat exchanger comprises: an enclosure frame; a plurality of heat exchanging pipes disposed through the enclosure frame; and a water collection box communicated with ends of the heat exchanging pipes that protrude out of the enclosure frame to connect the plurality of heat exchanging pipes into a continuous flow path; wherein the first temperature detection device is provided on the water collection box or on a portion of the enclosure frame that is adjacent to the heat exchanging pipes; and wherein the ignition temperature control apparatus of the gas water heater includes an electrically heating element that is provided on the water passage and/or on a portion of the heat exchanger that is adjacent to the combustion device.

8. The ignition temperature control apparatus of the gas water heater according to claim 7, wherein if the temperature detected by the first temperature detection device is lower than or equal to a second preset temperature or a rate of decline of the temperature detected by the first temperature detection device is higher than or equal to a second preset value, the controller controls the electrically heating element to be in an operating state, and controls the combustion device to be in a stop state; and wherein the second preset temperature is higher than or equal to the first preset temperature, and the second preset value is lower than or equal to the first preset value.

9. The ignition temperature control apparatus of the gas water heater according to claim 1, wherein the ignition temperature control apparatus of the gas water heater includes an electrically heating element and the first temperature detection device that are provided on the water passage.

10. The ignition temperature control apparatus of the gas water heater according to claim 9, wherein if the temperature detected by the first temperature detection device is lower than or equal to a third preset temperature or the rate of decline of the temperature detected by the first temperature detection device is higher than or equal to a third preset value, the controller controls the electrically heating element to be in an operating state; and wherein the third preset temperature is lower than or equal to the first preset temperature, and the third preset value is higher than the first preset value.

11. The ignition temperature control apparatus of the gas water heater according to claim 2, wherein the ignition temperature control apparatus of the gas water heater includes an electrically heating apparatus and a driving circuit that enables the electrically heating element to operate, the driving circuit including a temperature control part that is provided on the water passage and/or on a portion of the heat exchanger that is adjacent to the combustion device, and the temperature control part being capable of enabling the driving circuit to be switched on if a temperature at a position where the temperature control part is located is lower than or equal to a fourth preset temperature.

12. The ignition temperature control apparatus of the gas water heater according to claim 11, wherein the electrically heating element is provided on the water passage and/or on a portion of the heat exchanger that is adjacent to the combustion device.

13. The ignition temperature control apparatus of the gas water heater according to claim 2, wherein a second temperature detection device and an electrically heating element are provided on a portion of the heat exchanger that is adjacent to the combustion device and/or on the water passage.

14. The ignition temperature control apparatus of the gas water heater according to claim 13, wherein if a temperature detected by the second temperature detection device is lower than or equal to a fifth preset temperature or a rate of decline of a temperature detected by the second temperature detection device is higher than or equal to a fifth preset value, the controller controls the electrically heating element to be in an operating state and/or the controller controls the combustion device to operate in such a state that the requirement for thermal bearing capacity of the heat exchanger made of stainless steel is satisfied.

15. The ignition temperature control apparatus of the gas water heater according to claim 14, wherein if the temperature detected by the second temperature detection device is lower than or equal to the fifth preset temperature or the rate of decline of the temperature detected by the second temperature detection device is higher than or equal to the fifth preset value, the controller controls the electrically heating element and the combustion device to start at the same time; the controller first starts the combustion device, and then controls the electrically heating element to be in an operating state; or the controller first controls the electrically heating element to be in an operating state, and then starts the combustion device.

16. The ignition temperature control apparatus of the gas water heater according to claim 15, wherein if the temperature detected by the second temperature detection device is lower than or equal to a sixth preset temperature or the rate of decline of the temperature detected by the second temperature detection device is higher than or equal to a sixth preset value, the controller controls the combustion device to operate in such a state that the requirement for thermal bearing capacity of the heat exchanger made of stainless steel is satisfied; and wherein the sixth preset temperature is higher than or equal to the fifth preset temperature, and the sixth preset value is smaller than the fifth preset value.

17. The ignition temperature control apparatus of the gas water heater according to claim 1, wherein if the temperature detected by the first temperature detection device is lower than or equal to the first preset temperature or the rate of decline of the temperature detected by the first temperature detection device is higher than or equal to the first preset value, the controller controls the combustion device to operate in such a condition that a temperature of water in the heat exchanger is lower than a seventh preset temperature.

18. The ignition temperature control apparatus of the gas water heater according to claim 1, wherein if the temperature detected by the first temperature detection device is lower than or equal to the first preset temperature or the rate of decline of the temperature detected by the first temperature detection device is higher than or equal to the first preset value, the controller controls combustion time of the combustion device to increase as an output load decreases.

19. The ignition temperature control apparatus of the gas water heater according to claim 1, wherein if the temperature detected by the first temperature detection device is lower than or equal to the first preset temperature or the rate of decline of the temperature detected by the first temperature detection device is higher than or equal to the first preset value, the controller controls operation time of the combustion device to be within 8s to 10s and controls an output load of the combustion device to be within 11 kw to 18 kw.

20. The ignition temperature control apparatus of the gas water heater according to claim 1, wherein the combustion device has an anti-freezing work mode, and wherein if the temperature detected by the first temperature detection device is lower than or equal to the first preset temperature or the rate of decline of the temperature detected by the first temperature detection device is higher than or equal to the first preset value, the combustion device operates in the anti-freezing work mode in which an output load of the combustion device is lower than or equal to 18 kw.

21. The ignition temperature control apparatus of the gas water heater according to claim 20, wherein the combustion device has the anti-freezing work mode with a preset power output range, and wherein if the temperature detected by the first temperature detection device is lower than or equal to the first preset temperature or the rate of decline of the temperature detected by the first temperature detection device is higher than or equal to the first preset value, the controller controls the combustion device to operate in the anti-freezing work mode.

22. The ignition temperature control apparatus of the gas water heater according to claim 1, wherein if the temperature detected by the first temperature detection device is lower than or equal to the first preset temperature or the rate of decline of the temperature detected by the first temperature detection device is higher than or equal to the first preset value, the controller controls the combustion device to operate in such a state as to satisfy the requirement that a temperature of a surface of the heat exchanger made of stainless steel is lower than or equal to 300° C.

23. A gas water heater, comprising the ignition temperature control apparatus according to claim 1.

* * * * *